US011459809B1

(12) United States Patent
Hsu

(10) Patent No.: US 11,459,809 B1
(45) Date of Patent: Oct. 4, 2022

(54) HINGE

(71) Applicant: FOSITEK CORPORATION, New Taipei (TW)

(72) Inventor: An-Szu Hsu, New Taipei (TW)

(73) Assignee: FOSITEK CORPORATION, New Taipei (TW)

( * ) Notice: Subject to any disclaimer, the term of this patent is extended or adjusted under 35 U.S.C. 154(b) by 0 days.

(21) Appl. No.: 17/354,231

(22) Filed: Jun. 22, 2021

(30) Foreign Application Priority Data

Apr. 1, 2021 (TW) ..... 110112162

(51) Int. Cl.
*E05D 3/06* (2006.01)
*E05D 11/00* (2006.01)
*E05D 3/12* (2006.01)

(52) U.S. Cl.
CPC ..... *E05D 11/00* (2013.01); *E05D 3/122* (2013.01); *E05Y 2201/716* (2013.01); *E05Y 2201/722* (2013.01); *E05Y 2900/60* (2013.01)

(58) Field of Classification Search
CPC ..... G06F 1/16; G06F 1/1616; G06F 1/1681; G06F 1/166; G06F 1/1679; H04M 1/022; H04M 1/0214; H04M 1/0216; H04M 1/0222; H05K 5/0226; F16M 11/10; E05D 11/00; E05D 11/1021; E05D 11/1078; E05D 11/082; E05D 3/18; E05D 3/122; E05D 3/12; E05D 3/16; E05D 3/06; E05D 3/32; E05D 15/28; E05D 15/30; E05D 15/32; E05D 15/40; E05D 1/04; E05D 2001/045; E05Y 2900/606; E05Y 2900/60; E05Y 2201/716; E05Y 2201/722; Y10T 16/542; Y10T 16/543; Y10T 16/544;
(Continued)

(56) References Cited

U.S. PATENT DOCUMENTS 8,111,506 B2 * 2/2012 Wang ..... H04M 1/23 361/679.08
10,036,188 B1 * 7/2018 Yao ..... E05D 3/122
(Continued)

FOREIGN PATENT DOCUMENTS

CN 210178745 U * 3/2020 ..... F16C 11/04
TW I721711 B 3/2021

OTHER PUBLICATIONS

Taiwanese Search Report for Taiwanese Application No. 110112162, dated Nov. 29, 2021, with an English translation.

*Primary Examiner* — Chuck Y Mah
(74) *Attorney, Agent, or Firm* — Birch, Stewart, Kolasch & Birch, LLP

(57) ABSTRACT

A hinge includes first and second rotary members each rotatably mounted on a base seat about an axis in an axial direction between unfolded and folded positions, and a synchronizing unit including first and second racks which are movably mounted on the base seat in a lateral direction and respectively coupled with the first and second rotary members, and at least one pinion which is interposed between and meshes with the first and second racks to make opposite synchronizing movements of the first and second racks to transmit rotations of the first and second rotary members and the movements of the first and second racks to make opposite synchronizing rotations of the first and second rotary members.

8 Claims, 6 Drawing Sheets

(58) Field of Classification Search
CPC ..... Y10T 16/5443; Y10T 16/5445; Y10T 16/5448; Y10T 16/545; Y10T 16/54038
See application file for complete search history.

(56) References Cited

U.S. PATENT DOCUMENTS

| | | | | |
|---|---|---|---|---|
| 2016/0097227 | A1* | 4/2016 | Hsu | G06F 1/1681 16/354 |
| 2017/0003719 | A1* | 1/2017 | Siddiqui | E05D 11/082 |
| 2020/0352044 | A1* | 11/2020 | Hsu | H05K 5/0247 |
| 2020/0371561 | A1* | 11/2020 | Lin | G06F 1/1681 |
| 2020/0409427 | A1* | 12/2020 | Hsu | G06F 1/1641 |
| 2020/0409429 | A1* | 12/2020 | Hsu | G06F 1/1681 |
| 2021/0076520 | A1* | 3/2021 | Yen | H04M 1/022 |
| 2021/0267076 | A1* | 8/2021 | Zhang | E05D 11/1014 |
| 2022/0011827 | A1* | 1/2022 | Kim | G06F 1/1681 |

* cited by examiner

HINGE

CROSS-REFERENCE TO RELATED APPLICATION

This application claims priority of Taiwanese Patent Application No. 110112162, filed on Apr. 1, 2021.

FIELD

The disclosure relates to a hinge, and more particularly to a hinge with a synchronizing unit for rotating two rotary members to unfolded and folded states.

BACKGROUND

A conventional hinge generally requires multiple gears, such as eight gears, to perform a synchronous movement of two rotary members. The volume of such hinge is quite large. Additionally, a free and idle transmission during the synchronous movement is caused by backlashes of the multiple gears.

SUMMARY

Therefore, an object of the disclosure is to provide a hinge that can alleviate at least one of the drawbacks of the prior art.

According to the disclosure, the hinge includes abase seat, at least one first rotary member, at least one second rotary member and a synchronizing unit. The first rotary member is mounted on the base seat and is rotatable relative to the base seat about a first axis in an axial direction between a first unfolded position and a first folded position. The second rotary member is mounted on the base seat and is rotatable relative to the base seat about a second axis in the axial direction between a second unfolded position and a second folded position. The synchronizing unit includes a first rack which is mounted on the base seat and movable relative to the base seat in a lateral direction transverse to the axial direction, a second rack which is mounted on the base seat and movable relative to the base seat in the lateral direction, at least one pinion which is interposed between and meshes with the first and second racks to make opposite synchronizing movements of the first and second racks in the lateral direction, a first transmitting assembly which couples the first rotary member with the first rack to transmit a rotation of the first rotary member to make the movement of the first rack, and a second transmitting assembly which couples the second rotary member with the second rack to transmit the movement of the second rack to make a rotation of the second rotary member so as to make opposite synchronizing rotations of the first and second rotary members from the first and second unfolded positions to the first and second folded positions.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
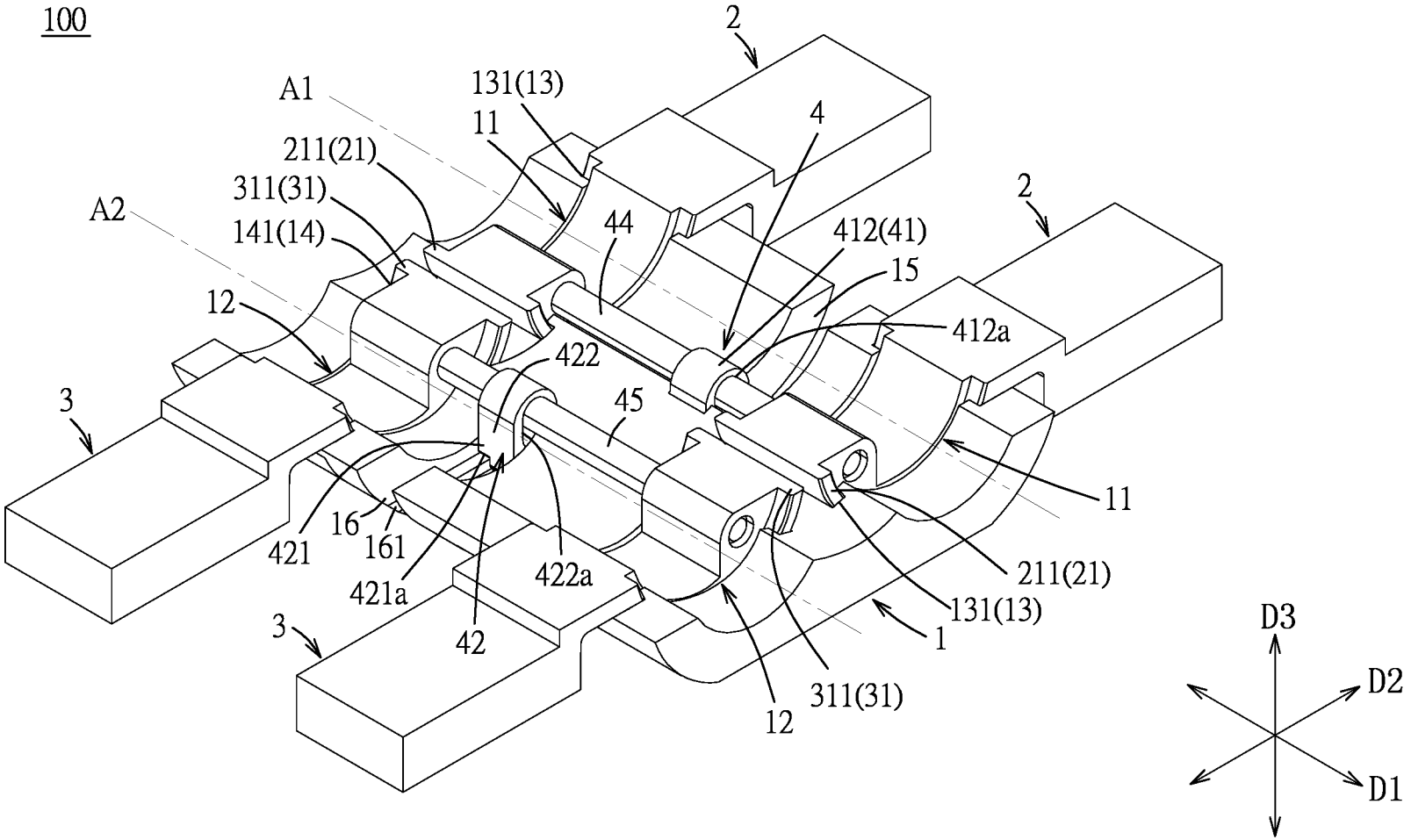
FIG. 1 is a perspective view illustrating an embodiment of a hinge according to the disclosure in an unfolded state.
Figure 2:
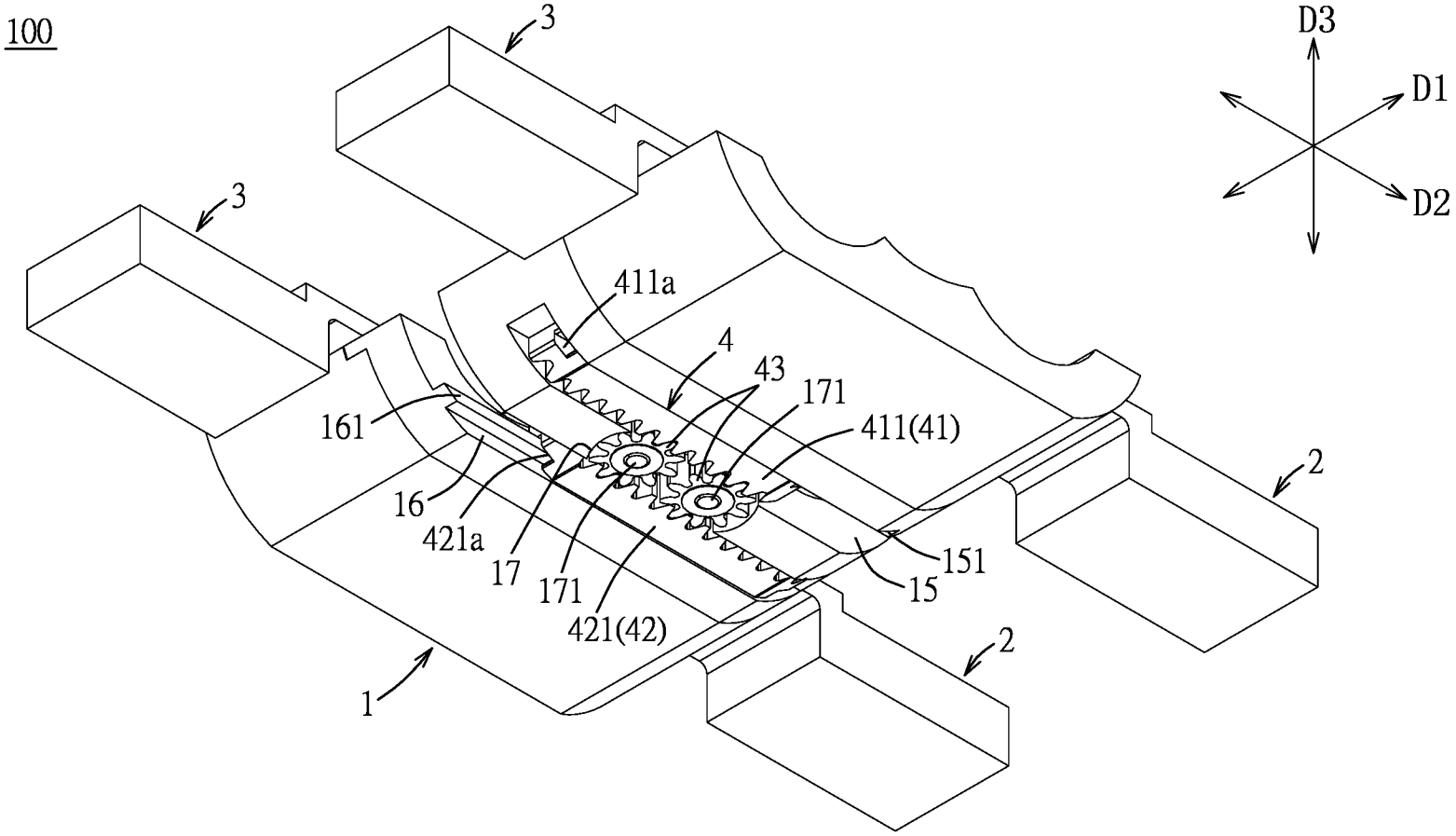
FIG. 2 is a perspective view of the embodiment similar to FIG. 1, but taken from another angle.
Figure 3:
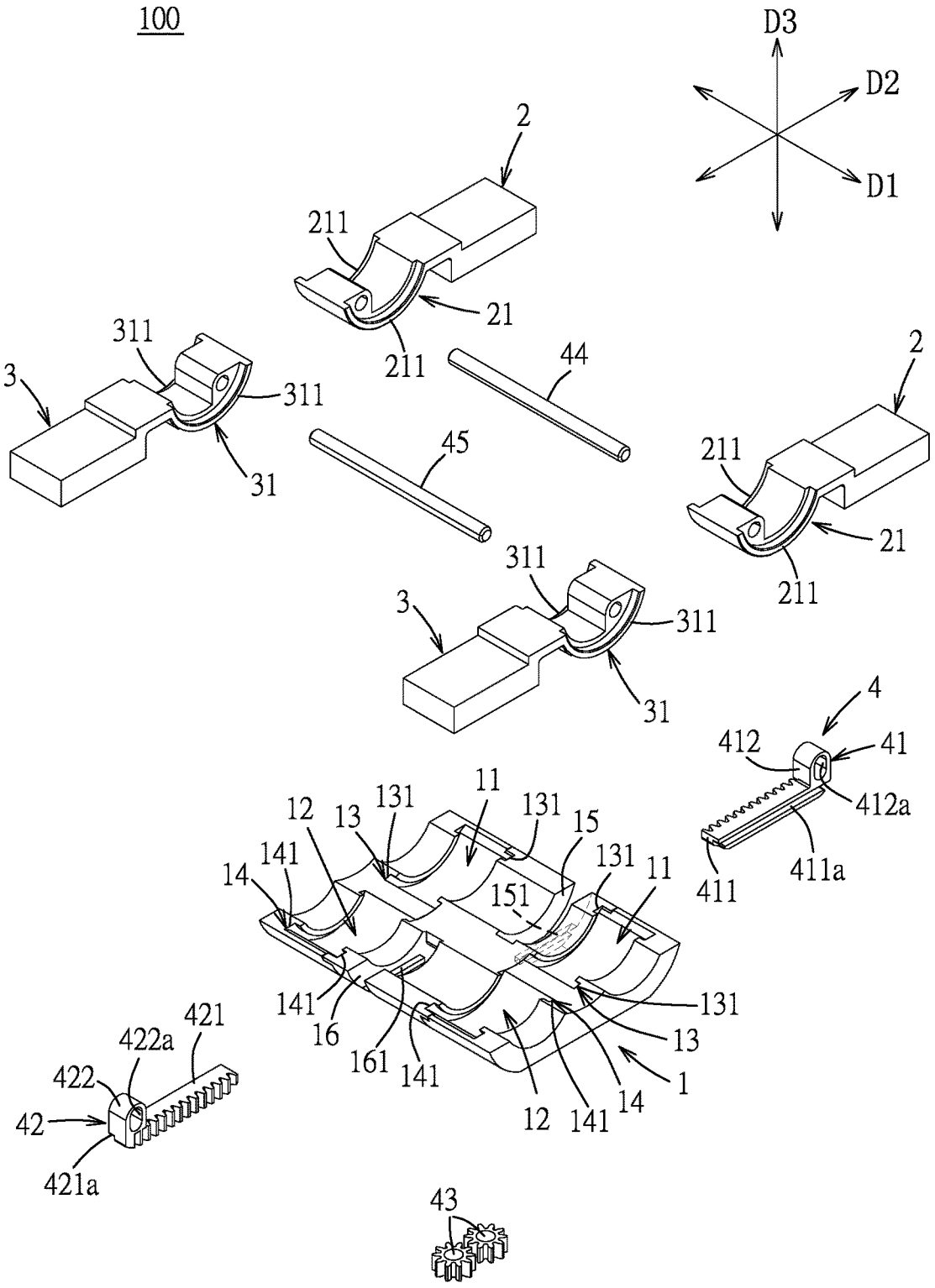
FIG. 3 is an exploded perspective view of FIG. 1.
Figure 4:
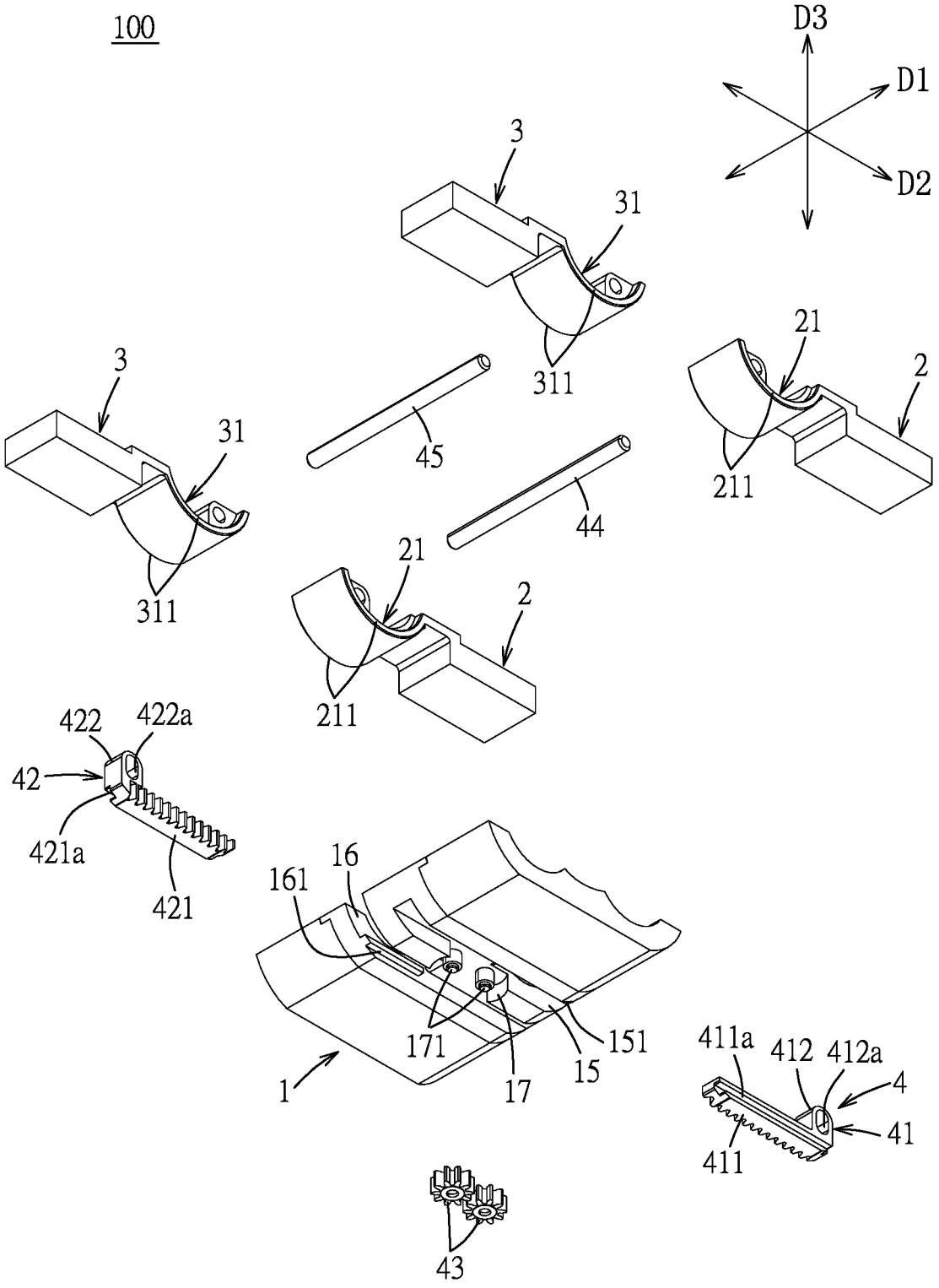
FIG. 4 is an exploded perspective view of FIG. 2.

Referring to FIGS. 1 to 4, an embodiment of a hinge 100 according to the disclosure includes a base seat 1, two first rotary members 2, two second rotary members 3 and a synchronizing unit 4.

The base seat 1 has two first arcuate slots 11 spaced apart from and aligned with each other in an axial direction (D1), two second arcuate slots 12 spaced apart from and aligned with each other in the axial direction (D1), two first rail features 13 respectively disposed in the first arcuate slots 11 and extending around a first axis (A1) parallel to the axial direction (D1), and two second rail features 14 respectively disposed in the second arcuate slots 12 and extending around a second axis (A2) parallel to the axial direction (D1). A respective pair of the first and second arcuate slots 11, 12 are spaced apart from and aligned with each other in a lateral direction (D2) that is transverse to the axial direction (D1). The first and second axes (A1, A2) are also spaced apart from and aligned with each other in the lateral direction (D2). Alternatively, in a modified embodiment, the first and second arcuate slots 11, 12 may be arranged alternately along the axial direction (D1) such that the first and second axes (A1, A2) overlap with each other.

Figure 5:
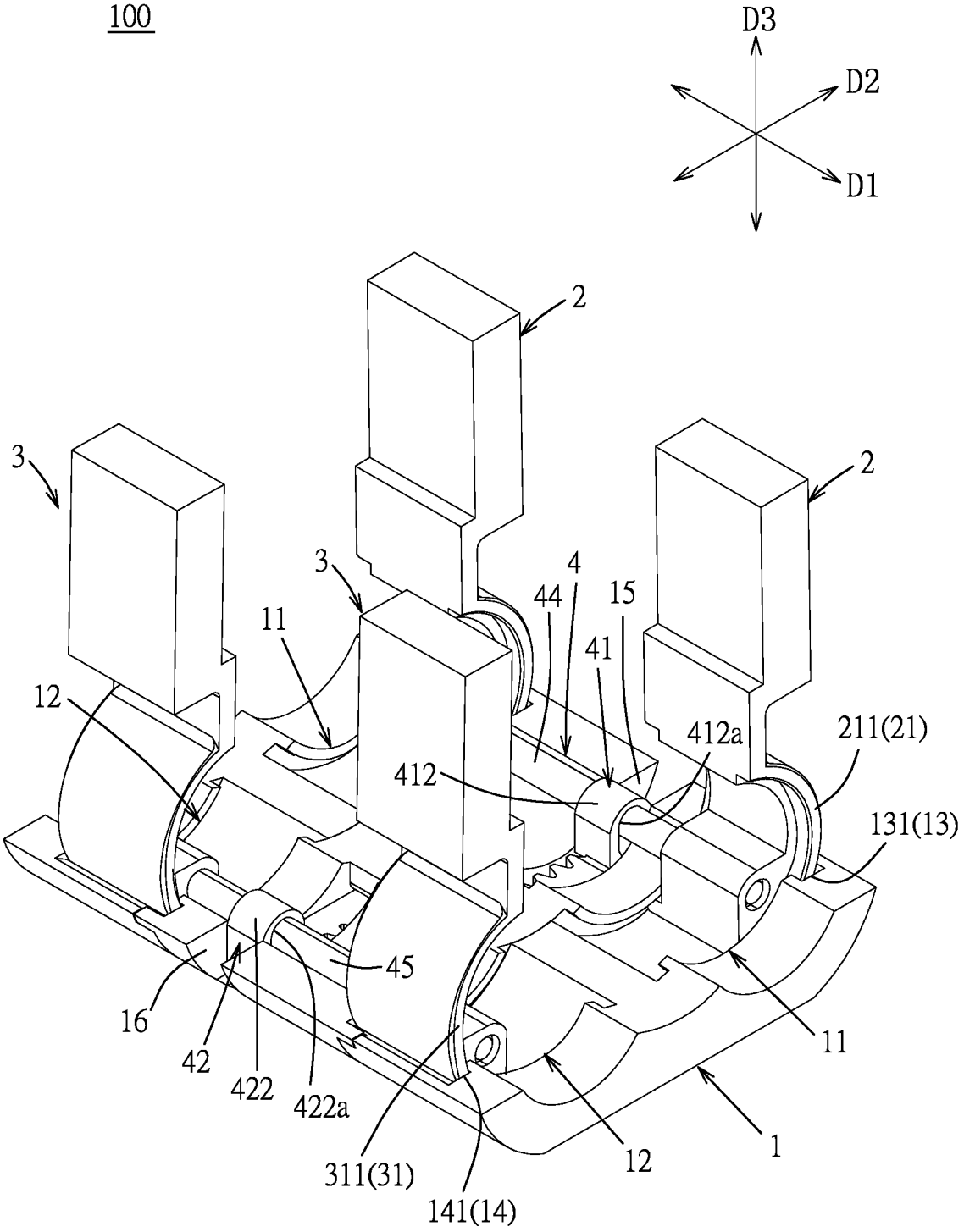
FIG. 5 is a perspective view illustrating the embodiment in a folded state.

With reference to FIGS. 1 and 3 to 5, each of the first rotary members 2 has a first sliding portion 21 slidably disposed in a respective one of the first arcuate slots 11. Each of the second rotary members 3 has a second sliding portion 31 slidably disposed in a respective one of the second arcuate slots 12. Specifically, each first rail feature 13 has two arcuate first rails 131 formed at two sides of the corresponding first arcuate slot 11 in the axial direction (D1). Each second rail feature 14 has two arcuate second rails 141 formed at two sides of the corresponding second arcuate slot 12 in the axial direction (D1). The first sliding portion 21 of each first rotary member 2 has two first arcuate flanges 211 which are slidably engaged with the first rails 131, respectively. The second sliding portion 31 of each second rotary member 3 has two second arcuate flanges 311 which are slidably engaged with the second rails 141, respectively. Through the sliding engagement of the first rails 131 with the first arcuate flanges 211, the two first rotary members 2 are rotatable relative to the base seat 1 about the first axis (A1) between a first unfolded position (see FIG. 1) and a first folded position (see FIG. 5). Through the sliding engagement of the second rails 141 with the second arcuate flanges 311, the two second rotary members 3 are rotatable relative to the base seat 1 about the second axis (A2) between a second unfolded position (see FIG. 1) and a second folded position (see FIG. 5).

In this embodiment, the first and second rotary members 2, 3 are rotatably mounted on the base seat 1 by sliding fitting engagement of the arcuate rails and flanges, and the first axis (A1) and the second axis (A2) are located above the hinge 100 in an upright direction (D3) transverse to both the axial direction (D1) and the lateral direction (D2). Thus, the thickness of the hinge 100 in the upright direction (D3) is relatively decreased as compared with that with hinge shafts (not shown) and hinge holes (not shown) pivoted to each other. In a various embodiment, each of the first and second rails 131, 141 may be in the form of a bar projecting from a side face of the arcuate slot 11, 12, and each of the first and second arcuate flanges 211, 311 may be concaved from a side face of the sliding portion 21, 31 to be in slidably fitted engagement with the corresponding bar-like rail 131, 141.

Figure 6:
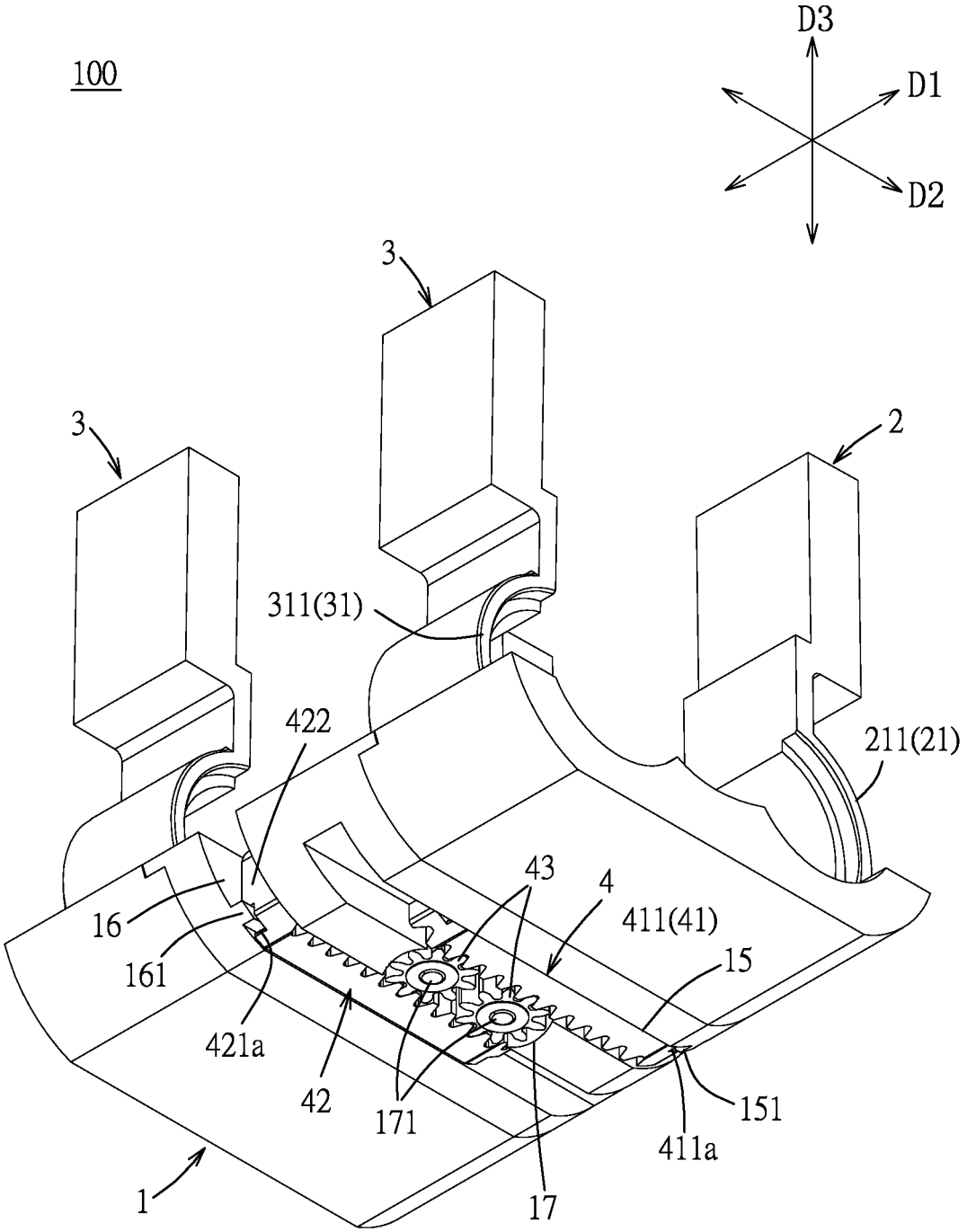
FIG. 6 is a perspective view of the embodiment similar to FIG. 5, but taken from another angle.

With reference to FIGS. 1, 2, 4 and 6, the synchronizing unit 4 includes a first rack 41 which is mounted on the base seat 1 and movable relative to the base seat 1 in the lateral direction (D2), a second rack 42 which is mounted on the base seat 1 and movable relative to the base seat 1 in the lateral direction (D2), two pinions 43, each of which is interposed between and meshes with the first and second racks 41, 42 to make opposite synchronizing movements of the first and second racks 41, 42 in the lateral direction (D2), a first transmitting assembly which couples the first rotary member 2 with the first rack 41 to transmit the rotation of the first rotary member 2 to make the movement of the first rack 41, and a second transmitting assembly which couples the second rotary member 3 with the second rack 42 to transmit the movement of the second rack 42 to make the rotation of the second rotary member 3 so as to make opposite synchronizing rotations of the first and second rotary members 2, 3 from the first and second unfolded positions to the first and second folded positions.

Specifically, in this embodiment, the base seat 1 has a first sliding slot 15 and a second sliding slot 16 which extend therethrough in the upright direction (D3) and which are spaced apart from each other in the axial direction (D1), and a pinion receiving slot 17 which is formed between and in communication with the first and second sliding slots 15, 16 for accommodating the pinions 43 and permitting rotation of the pinions 43 therein about their pinion axes that extend in the upright direction (D3). Each of the first and second sliding slots 15, 16 extends in the lateral direction (D2). A first guiding protrusion 151 and a second guiding protrusion 161 are formed in the first and second sliding slots 15, 16, respectively, and are elongated in the lateral direction (D2). The first rack 41 has a first rack body 411 slidably disposed in the first sliding slot 15 and meshing with the two pinions 43, and a first connecting portion 412 extending upwardly from an end of the first rack body 411 and outwardly of the first sliding slot 15. The first rack body 411 has a first guiding groove (411*a*) extending in the lateral direction (D2) to be fittingly and slidably engaged with the first guiding protrusion 151. Similarly, the second rack 42 has a second rack body 421 slidably disposed in the second sliding slot 16 and meshing with the two pinions 43, and a second connecting portion 422 extending upwardly from an end of the second rack body 421 and outwardly of the second sliding slot 16. The second rack body 421 has a second guiding groove (421*a*) extending in the lateral direction (D2) to be fittingly and slidably engaged with the second guiding protrusion 161. By means of the slidable and fitting engagement of the first and second guiding protrusions 151,161 with the first and second guiding grooves (411*a*, 421*a*), the first and second racks 41, 42 are slidably engaged in the first and second sliding slots 15, 16, respectively, in the lateral direction (D2). Moreover, since the pinions 43 are interposed between the first and second racks 41, 42 and are rotatable about the upright pinion axes, the thickness of the base seat 1 in the upright direction (D3) is further decreased.

Specifically, the first transmitting assembly includes a first confining hole (412*a*) formed in and extending through the first connecting portion 412 in the axial direction (D1) and elongated in the upright direction (D3), and a first transmitting shaft 44 extending in the axial direction (D1) and having two shaft ends which are respectively connected with the first rotary members 2, and a middle portion which rotatably and slidably extends through the first confining hole (412*a*) so as to interconnect the first rack 41 and the two first rotary members 2 to transmit the rotation of the first rotary members 2 and make the movement of the first rack 41. Similarly, the second transmitting assembly includes a second confining hole (422*a*) formed in and extending through the second connecting portion 422 in the axial direction (D1) and elongated in the upright direction (D3), and a second transmitting shaft 45 extending in the axial direction (D1) and having two shaft ends which are respectively connected with the second rotary members 3, and a middle portion which rotatably and slidably extends through the second confining hole (422*a*) so as to interconnect the second rack 42 and the two second rotary members 3 to transmit the movement of the second rack 42 and make the rotation of the second rotary members 3. More specifically, the first transmitting shaft 44 is disposed on the first rotary members 2 and is slidably confined in the first confining hole (412*a*) to only permit sliding movement of the first transmitting shaft 44 in the upright direction (D3). The second transmitting shaft 45 is disposed on the second rotary members 3 and is slidably confined in the second confining hole (422*a*) to only permit sliding movement of the second transmitting shaft 45 in the upright direction (D3). Thus, the first rack 41 is movable in the lateral direction (D2) along with the first transmitting shaft 44 during the rotation of the first rotary members 2, and the second rack 42 is movable in the lateral direction (D2) along with the second transmitting shaft 45 during the rotation of the second rotary members 3.

Further, two mounting posts 171 are disposed in the pinion receiving slot 17 and extend in the upright direction (D3) to define the pinion axes such that the pinions 43 are pivotally connected on the mounting posts 171, respectively, and mesh with the first and second racks 41, 42. With the rotation of the pinions 43, the two first rotary members 2 and the two second rotary members 3 are rotated synchronously and in opposite rotational directions through the opposite movements of the first and second racks 41, 42.

With reference to FIGS. 1, 2, 5 and 6, when the two first rotary members 2 and the two second rotary members 3 are rotated (i.e. slide along the rail features 13, 14) in opposite directions relative to the base seat 1 with the opposite movement of the first and second racks 41, 42 from the first and second unfolded positions (see FIG. 1) to the first and second folded positions (see FIG. 5), the two first rotary members 2 and the two second rotary members 3 are shifted from an unfolded state to a folded state. For example, the two first rotary members 2 are connected with a first casing part (not shown), and the two second rotary members 3 are connected with a second casing part (not shown) such that the first and second casing parts are unfolded and folded along with the unfolding and folding of the first and second rotary members 2, 3. Moreover, the number of the first rotary members 2 and the number of the second rotary members 3 may be varied, such as one or more than two. The number of the pinions 43 may be varied, such as one or more than two. The increase in the number of the pinions 43 can reduce a free and idle transmission between the pinions 43 and one of the first rack 41 and the second rack 42 during the synchronous movement.

As illustrated, with the synchronizing unit 4 having the first and second racks 41, 42 movable with the first and second rotary members 2, 3, and the pinions 43 meshing with the first and second racks 41, 42, the opposite synchronizing rotations of the first and second rotary members 2, 3 can be made, which reduces the amount of the required pinions in the hinge 100 so as to reduce the volume of the hinge 100 and hence reduce the free and idle transmission during the synchronous movement.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A hinge comprising:

a base seat;

at least one first rotary member mounted on said base seat and rotatable relative to said base seat about a first axis in an axial direction between a first unfolded position and a first folded position;

at least one second rotary member mounted on said base seat and rotatable relative to said base seat about a second axis in the axial direction between a second unfolded position and a second folded position; and a synchronizing unit including a first rack which is mounted on said base seat and movable relative to said base seat in a lateral direction transverse to the axial direction, a second rack which is mounted on said base seat and movable relative to said base seat in the lateral direction, at least one pinion which is interposed between and meshes with said first and second racks to make opposite synchronizing movements of said first and second racks in the lateral direction, a first transmitting assembly which couples said first rotary member with said first rack to transmit a rotation of said first rotary member to make the movement of said first rack, and a second transmitting assembly which couples said second rotary member with said second rack to transmit the movement of said second rack to make a rotation of said second rotary member so as to make opposite synchronizing rotations of said first and second rotary members from the first and second unfolded positions to the first and second folded positions, said base seat having at least one first rail feature extending around the first axis, and at least one second rail feature extending around the second axis, said first rotary member having a first sliding portion which is slidably engaged with said first rail feature to be rotatable relative to said base seat about the first axis between the first unfolded position and the first folded position, said second rotary member having a second sliding portion which is slidably engaged with said second rail feature to be rotatable relative to said base seat about the second axis between the second unfolded position and the second folded position.

2. The hinge as claimed in claim 1, wherein the first axis is parallel to the second axis, said base seat having a first sliding slot and a second sliding slot which extend in the lateral direction and which are spaced apart from each other in the axial direction, said first and second racks being slidably engaged in said first and second sliding slots, respectively, said pinion being interposed between said first and second sliding slots and being rotatable about a pinion axis which extends in an upright direction that is transverse to both the axial direction and the lateral direction.

3. The hinge as claimed in claim 2, wherein said base seat has first and second guiding protrusions formed in said first and second sliding slots, respectively, and elongated in the lateral direction, said first and second racks respectively having first and second guiding grooves extending in the lateral direction to be fittingly and slidably engaged with said first and second guiding protrusions, respectively.

4. The hinge as claimed in claim 2, wherein said base seat has a pinion receiving slot formed between and in communication with said first and second sliding slots for accommodating said pinion and permitting rotation of said pinion therein.

5. The hinge as claimed in claim 4, wherein said first rack has a first rack body slidably disposed in said first sliding slot, and a first connecting portion extending from an end of said first rack body and outwardly of said first sliding slot, said second rack having a second rack body slidably disposed in said second sliding slot, and a second connecting portion extending from an end of said second rack body and outwardly of said second sliding slot, said first transmitting assembly including a first transmitting shaft extending in the axial direction and interconnecting said first connecting portion and said first rotary member, said second transmitting assembly including a second transmitting shaft extending in the axial direction and interconnecting said second connecting portion and said second rotary member.

6. The hinge as claimed in claim 5, wherein said first transmitting assembly further includes a first confining hole formed in said first connecting portion and elongated in the upright direction, said second transmitting assembly further including a second confining hole formed in said second connecting portion and elongated in the upright direction, said first transmitting shaft being disposed on said first rotary member and slidably confined in said first confining hole, said second transmitting shaft being disposed on said second rotary member and slidably confined in said second confining hole.

7. The hinge as claimed in claim 1, wherein said base seat has two of said first rail features which are spaced apart from and aligned with each other in the axial direction, and two of said second rail features which are spaced apart from and aligned with each other in the axial direction, said hinge comprising two of said first rotary members which are rotatably mounted on said first rail features, respectively, and two of said second rotary members which are rotatably mounted on said second rail features, respectively, said first transmitting shaft having two shaft ends which are respectively connected with said first rotary members and a middle portion which rotatably and slidably extends through said first confining hole, said second transmitting shaft having two shaft ends which are respectively connected with said second rotary members and a middle portion which rotatably and slidably extends through said second confining hole.

8. The hinge as claimed in claim 1, wherein said base seat has a first arcuate slot and a second arcuate slot such that said first sliding portion and said second sliding portion are slidably disposed in said first arcuate slot and said second arcuate slot, respectively, said first rail feature having two first rails formed at two sides of said first arcuate slot in the axial direction, said first sliding portion having two first arcuate flanges which are slidably engaged with said first rails, respectively, said second rail feature having two second rails formed at two sides of said second arcuate slot in the axial direction, said second sliding portion having two second arcuate flanges which are slidably engaged with said second rails, respectively.

* * * * *